United States Patent [19]

Long

[11] Patent Number: 4,459,934

[45] Date of Patent: Jul. 17, 1984

[54] ANCHOR

[76] Inventor: George W. Long, 122 S. Golden Mall, Burbank, Calif. 91502

[21] Appl. No.: 360,695

[22] Filed: Mar. 22, 1982

[51] Int. Cl.[3] ..... B63B 21/36

[52] U.S. Cl. ..... 114/304

[58] Field of Search ..... 114/294–295, 114/297–299, 301–310

[56] References Cited

U.S. PATENT DOCUMENTS 19,659 3/1858 Williams ..... 114/305

FOREIGN PATENT DOCUMENTS 28205 of 1908 United Kingdom ..... 114/308

731563 6/1955 United Kingdom ..... 114/304

*Primary Examiner*—Trygve M. Blix

*Assistant Examiner*—Jesûs D. Sotelo

*Attorney, Agent, or Firm*—Christie, Parker & Hale

[57] ABSTRACT

An anchor comprises a shank and a pair of flukes with pointed ends. The flukes are pivotally mounted to a lower portion of the shank so the flukes extend upwardly from the pivot along opposite sides of the shank. The flukes pivot as a unit about an axis through the lower portion of the shank. A counterweight, preferably in the form of a solid metal block, is secured adjacent the bottom of the flukes to pivot with the flukes. The counterweight is mounted on a side of the pivot axis opposite the flukes. Preferably, the counterweight has a weight substantially greater than the combined weight of the flukes to produce a greater moment about the pivot axis than the moment produced by the flukes. Separate pairs of claws project outwardly from each side of the counterweight and are curved generally toward the pointed tips of the flukes. The claws provide frictional contact or drag with the bottom of the water to pivot the flukes relative to the shank so the pointed tips of the flukes penetrate the bottom. Continued pull on a line secured to the shank causes the weight of the counterweight to act downwardly and force the tips of the flukes into the bottom to bury the anchor in the bottom.

24 Claims, 6 Drawing Figures

2
2
10
12
12
14
14
12
16
16
22
22
22
22
24
24
24
25
25
26
26
28
28
28
29
29
30
32
34
34
36
38
40
40
42
42
42
44
44
46
46
46
48
50
50
52
52
54
54
56
56
58
60
60
60
62
62
64
64
18
18
18
20

10
18
22
24
34
36
46
48
50
56
66
68

ANCHOR

BACKGROUND OF THE INVENTION

This invention relates to anchors, and more particularly, to an anchor having improved holding ability.

DESCRIPTION OF THE PRIOR ART

Anchors have been used for centuries, starting with a heavy stone tied to a rope. Eventually, it became apparent that anchors could hold better by their shape, rather than by weight alone.

Over the years, various anchor designs have evolved, with the principal concerns being good penetrating ability per weight of the anchor, ability to hold on bottoms of various types, and ease of retrieval and stowage. Each anchor design has served a purpose for a particular type and size of boat or ship and each is efficient in one or two types of bottom but usually less desirable in others. Handling and stowage have caused additional problems. The ideal universal anchor has been elusive.

In recent years probably the most popular anchor design for pleasure boating is the so-called Danforth anchor. This anchor, which is also referred to as a lightweight anchor, has a pair of large flat flukes with pointed tips. The flukes extend close to the shank and are hinged at the bottom of the shank. When the anchor is dropped, the flukes pivot away from the shank, and a ramp on the crown of the anchor lifts the rear of the flukes so the tips of the flukes can contact the bottom. Continued pull on the line hopefully causes the flukes to dig into the bottom to bury the anchor. A separate larger Danforth anchor is available and used with a large amount of chain when the need for a storm anchor arises.

Another anchor design is the Hawkins anchor which pre-dated the Danforth anchor. The Hawkins anchor has a pair of thick, heavier flukes hinged to the bottom of the shank. The Hawkins anchor functions in a manner similar to the Danforth anchor and is in common use today.

I have discovered that the Danforth and Hawkins anchors, as well as other anchors for that matter, lack the capability of consistently holding in all types of penetrable bottoms. For example, the bottom of some bodies of water can be reasonably soft, consisting of mud or soft sand. The character of the bottom affects the holding power of the anchor, and a soft bottom offers the best ground for an anchor to penetrate. Other bottoms can consist of sand and gravel, even large rocks, and for some anchors these bottoms present problems. Hard sand or clay can make the bottom harder and more difficult to penetrate. It has been my experience that the Danforth anchor will work reasonably well in a soft bottom, but it can have problems penetrating the more dense bottoms. In soft sand or mud, it probably penetrates and holds as well as any anchor to date. In a bottom of dense sand, for instance, the smaller Danforth anchor can simply be pulled all the way in without having the flukes catch and penetrate.

The Danforth anchor can have problems with a combination of wind drag and wave action causing it to surface or "float". On the other hand, a steady pull on the light weight Danforth anchor makes this anchor hard to beat in reasonably soft bottoms. The long flukes and long stock of the larger Danforth anchor make it difficult to handle when attempting to bring the anchor onboard a boat. The anchors with larger, heavier flukes, such as the Hawkins anchor, have little holding power in a bottom of soft sand or mud. The larger Hawkins anchors will penetrate and hold reasonably well in more dense bottoms that are impenetrable by many other anchors. In smaller anchors, the thickness and weight of the flukes per total weight often keep the anchor from penetrating fairly dense bottoms. They will tend to "walk" or "crab", i.e., tend to skip across the bottom on the tips of its flukes, without good penetration, particularly on a gravel bottom.

Because of these problems with different types of bottoms, many anchors are used for limited types of bottoms and other anchors have to be used for other conditions. In addition, some types of anchors work well under ordinary wave and wind conditions but must be replaced when a storm anchor is required. That is, when there are strong winds or heavy wave action at the surface, an anchor may easily pull out of the bottom with a sudden force on the line. In these cases, many boat owners often carry a separate storm anchor for use in storm conditions.

The present invention provides an anchor having quick and positive penetration ability in all penetrable bottoms, including hard bottoms of dense sand. In addition, the anchor is of reasonably light weight per pound of holding power, can be handled and stowed, and can be used as a storm anchor.

SUMMARY OF THE INVENTION

Briefly, the anchor of this invention includes a pair of pointed flukes extending along opposite sides of a shank, and a pivot holding the flukes adjacent the bottom of the shank for allowing the flukes to pivot about an axis near the bottom of the shank. A counterweight is secured to the head of the anchor on a side of the pivot axis opposite the tips of the flukes. The counterweight preferably weighs more than the combined weight of the flukes to provide a greater turning moment around the pivot axis than the moment provided by the flukes. The anchor also includes spaced apart claws near the interface between the counterweight and the bottoms of the flukes. The claws project in a direction generally outwardly from the counterweight and generally toward the flukes. The claws provide means for catching the anchor on the bottom for forcing the tips of the flukes to penetrate the bottom initially, after which the weight of the counterweight can then act in a downward direction to force the tips of the flukes farther into the bottom.

These and other aspects of the invention will be more fully understood by referring to the following detailed description and the accompanying drawings.

DRAWINGS

DETAILED DESCRIPTION

Figures 1, 2:
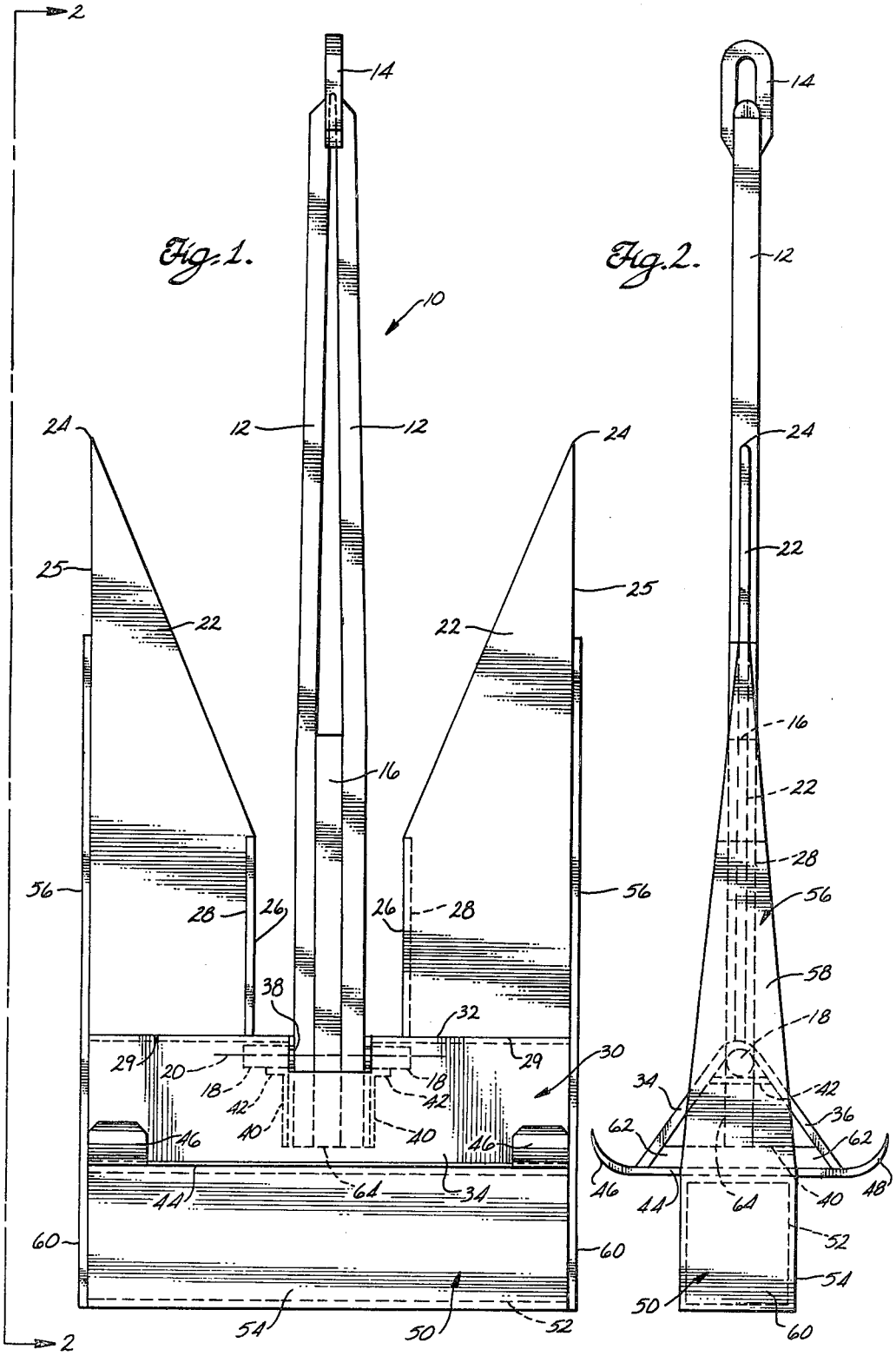
FIG. 1 is a front elevation view showing an anchor according to principles of this invention.
FIG. 2 is a side elevation view taken on line 2—2 of FIG. 1.

Referring to FIGS. 1 and 2, an anchor according to principles of this invention includes an upright shank 10 having a pair of rounded main rods 12 extending the length of the shank. The top ends of the main rods are held closely together, and a loop 14 such as a chain link is welded between and to the ends of the rods to form an eye at the top of the shank. The two main rods are spaced slightly apart from one another for little more than one-half the length of the shank, with the space between them tapering wider away from the top of the shank. A short lower rod 16 is welded between the lower end portions of the two main rods 12. The three side-by-side rods make up the bottom portion of the shank and extend somewhat less than about one-half the length of the shank.

A pair of cylindrical posts 18 are welded to the outside of the main rods 12 near the bottom of the shank. The two posts extend laterally away from opposite sides of the shank. The two posts are coaxially aligned with one another along a pivot axis 20 shown in phantom lines in FIG. 1. The posts provide a pivot pin or shaft on which the anchor can pivot relative to the shank as described below.

The anchoring portion of the anchor includes a pair of relatively thin, flat, large surface area flukes 22 with pointed tips 24. The flukes are closely spaced apart from opposite sides of the shank 10. The flukes lie in a common plane and extend for a length somewhat more than half the length of the shank. Each fluke has a generally triangular upper portion preferably in the shape of a right triangle which merges into a rectangular lower portion at the base of the triangle. The tips 24 of the flukes 22 are spaced farthest from the pivot axis 20 of the anchor, closest to the top of the shank. The tips of the flukes are at the other edges 25 of the flukes. The flukes taper wider downwardly away from the tips of the flukes toward the bottom of the shank for about two-thirds the length of the flukes. For about the bottom one-third of their length, the flukes are of maximum width, with parallel short inside edges 26 extending parallel to the long, straight, parallel outside edges 25 of the flukes. Separate flanges 28 extend along each straight inside edge of the flukes to provide stiffening for each fluke. The flukes have straight bottom edges 29 which are aligned with one another in a common plane.

The bottom edges of the flukes are welded to the top of an elongated triangular housing 30. The bottoms of the flukes are affixed to a long upper edge 32 of the triangular housing which forms the apex of the triangle. Thus, the large surface areas of the flukes lie in a common plane. The triangular housing has elongated front and rear faces 34 and 36 extending angularly downwardly and outwardly from the apex of the housing toward the bottom of the anchor. The front and rear faces of the triangular housing extend the width of the anchor, from the outer edge of one fluke to the outer edge of the other fluke.

A rectangular opening 38 is cut in the top center of housing 30. The width of the opening is just slightly wider than the width of the lower portion of the shank 10. In assembly, the top of the shank is inserted through the opening, and the shank is pulled up through the opening until the posts 18 make contact with the underside of the housing at its apex. The posts thus act as a pivot, as the underside of the housing makes rolling contact with the posts for permitting the triangular housing to rotate generally about the axis 20 of the posts.

A pair of angled plates 40 are welded to the underside of the triangular housing adjacent opposite sides of the shank below the posts. Main portions of each plate are shaped as a trapezoid and span the width of the triangular housing, as shown best in FIG. 2. A separate flange 42 at the top of each plate is turned outwardly away from the shank. The posts 18 rest on top of the flanges, making a snug rolling contact with the tops of the flanges. This prevents the triangular housing from wobbling on the posts when pivoting relative to the bottom of the shank. Owing to the pivot provided by the posts 18, the shank is freely rotatable relative to the flukes to either side of a vertical plane through the flukes.

The bottom of the triangular housing is formed by an elongated flat plate 44. Principally, the plate 44 is rectangular in shape and is welded to the bottom edges of the faces 34 and 36 of the triangular housing for closing off the bottom of the triangular housing. The bottom plate 44 also includes a pair of spaced apart claws 46 below the front face of the housing, and another pair of spaced apart claws 48 below the rear face of the housing. The claws are located adjacent the outer edges of the housing so that they are spaced apart by most of the width of the housing. The claws project outwardly away from the bottom edges of the triangular housing and they curve toward the tips of the flukes. Thus, the triangular housing projects downwardly and outwardly away from opposite faces of the flukes and the claws project beyond both faces of the triangular housing. This structure is best viewed in FIG. 2. The claws on each side of the anchor also are spaced apart along a continuous projecting edge at the interface between the faces 34 and 36 of the triangular housing 30 and the counterweight 50. Each projecting edge extends across the width of the flukes (as shown in FIG. 1) and is spaced outwardly from the face of the flukes and the counterweight (as shown in FIG. 2). The claws project outwardly from the projecting edge on each side of the anchor.

An elongated counterweight 50 is secured to the bottom of the triangular housing. The counterweight is preferably a solid block of material having a weight greater than the combined weight of the flukes. A' purpose of the counterweight is to add a substantial amount of weight to the crown of the anchor on a side of the pivot axis opposite the flukes. The drawings show one form of the counterweight in which a solid, rectangular block of metal 52 extending the entire width of the anchor is inserted into a thin-walled, tubular rectangular outer housing 54. The rectangular block 52 can be made of solid cast iron, and the tubular housing 54 can be made of stainless steel to reduce materials cost and prevent corrosion. The top of the tubular housing is welded to the bottom plate 44 of the triangular housing. The counterweight also can be a solid metal block with a plastic outer coating to reduce corrosion.

A pair of thin, flat side plates 56 are secured to opposite sides of the anchor. Each side plate has a generally triangular-shaped, upper portion 58 and a rectangular lower portion 60. The triangular upper portions of the side plates extend along the outer edges of the flukes. Below the flukes, the side plates cover most of the open ends of the triangular housing, leaving open vents 62 from the housing along opposite edges of each side plate. The rectangular lower portions of the side plates cover opposite ends of the rectangular housing 54 of the counterweight 50. The side plates are welded to the outer edges of the flukes, the triangular housing and the rectangular housing portion of the counterweight.

The counterweight extends across the bottom of the anchor, well below the pivot axis 20 near the bottom of the shank. Because the counterweight is substantially heavier than the flukes, the anchor normally maintains the upright position shown in FIG. 2 when the flukes and counterweight are freely allowed to pivot at the bottom of the shank. In said upright position the flukes extend generally upright and generally in a common plane with the shank when the shank is freely suspended vertically from the end of a line (not shown). When the anchor is viewed from the side, as best illustrated in FIG. 2, the counterweight is substantially wider than the flukes. The counterweight can be in various forms and sizes, including spaced apart blocks, if desired, so long as the counterweight adds the necessary heavy mass to the bottom of the anchor on a side of the pivot opposite the tips of the flukes. The claws 46, 48 project laterally outwardly well beyond the opposite sides of the counterweight. The pair of spaced apart claws on each side of the anchor project generally at a right angle away from the plane of the flukes and are then curved upwardly generally toward the tip of the flukes. The claws on each side of the counterweight are aligned generally in a common plane, and both sets of claws are located below the pivot axis of the anchor along with the counterweight. The claws are preferably located between the bottoms of the flukes and the bottom of the counterweight.

Figure 3:
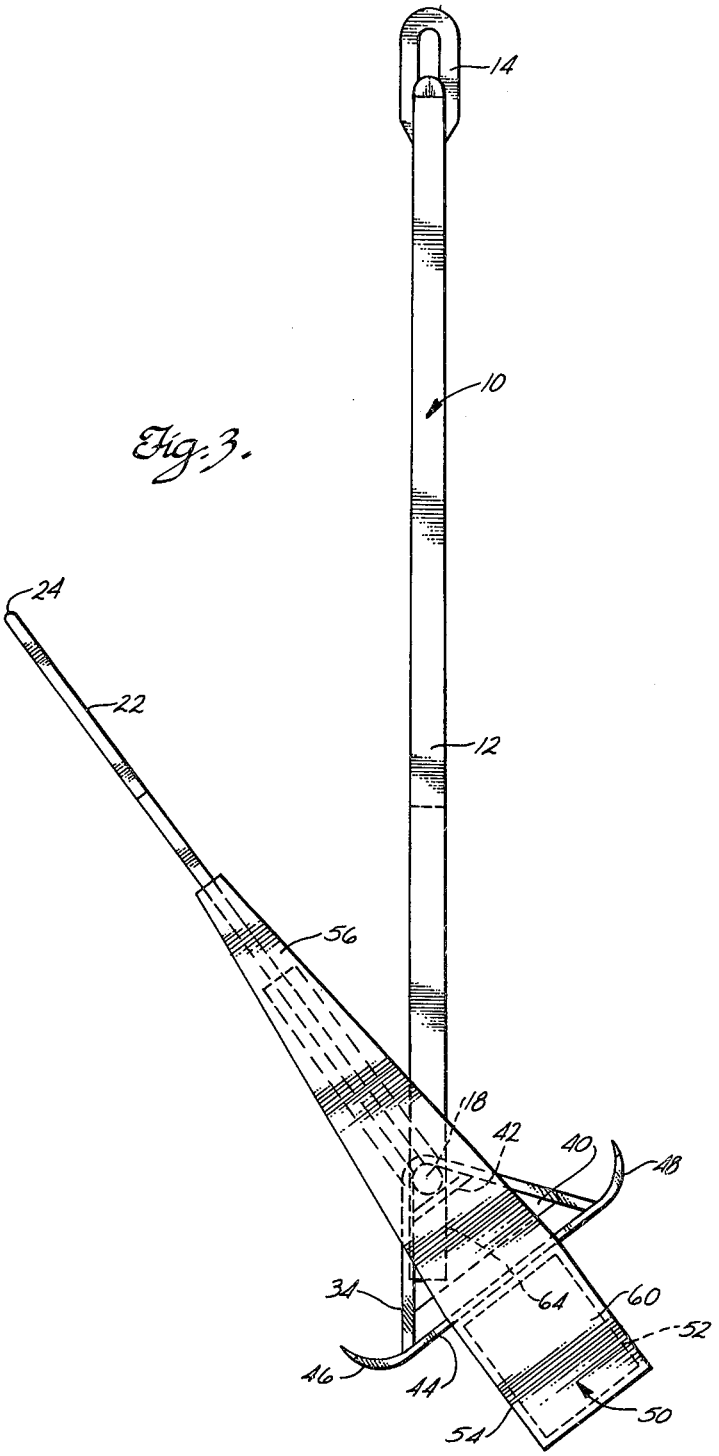
FIG. 3 is a side elevation view similar to FIG. 2 but showing the flukes of the anchor at an angle to the shank of the anchor.

FIG. 3 best illustrates how the anchor can pivot relative to the shank. The triangular housing, the flukes and the counterweight are rigidly secured to one another as a unit, and they can rotate as a unit about the pivot near the bottom of the shank. The bottom portion 64 of the shank, which extends below the pivot axis of the anchor, can contact the underside of either face 34 or 36 of the triangular housing to act as a stop as the anchor pivots away from either side of the shank. Preferably, maximum rotation of the anchor in either direction is $37\frac{1}{2}°$, although this angle can vary if desired. Rotation of the flukes and counterweight, as illustrated in FIG. 3, is normally not possible, unless the flukes are pulled to one side of the shank either by contact between the flukes and ground, or by contact between the claws and ground. As mentioned above, when the anchor is freely suspended from a line, the symmetrical positioning of the counterweight at the base of the flukes, below the pivot, causes the flukes to normally assume the upright position shown in FIG. 2, owing to the substantial mass of the counterweight acting under the influence of gravity below the pivot axis. The moment produced by the counterweight about the pivot axis 20 is greater than the moment produced about the same axis by the flukes. Preferably, the moment produced by the counterweight is at least about 20% greater than the moment produced by the flukes.

Figures 4, 5, 6:
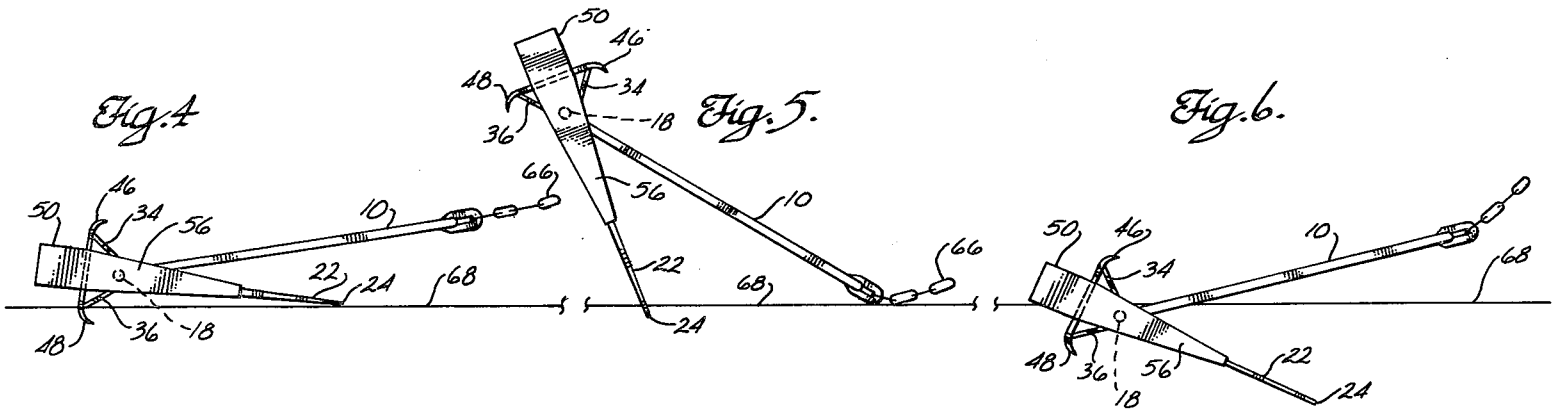
FIGS. 4, 5 and 6 are schematic side elevation views illustrating the sequential steps of setting the anchor.

FIGS. 4 through 6 schematically illustrate the anchor in use. The three figures illustrate sequential steps in which the anchor is suspended from a line 66 and is being set in the bottom 68 of a body of water as continuous tension is being applied to the line toward the right in FIGS. 4 through 6.

In use, when the anchor is being let down toward the bottom 68, the flukes 22 remain essentially in the upright position, as illustrated in FIG. 2. Even when the shank 10 is at an angle to the vertical, the flukes of the anchor will stay essentially vertical as the anchor is being dropped or lifted. When the anchor first hits the bottom, the counterweight 50 first makes contact with the bottom, which immediately causes the anchor to flip to the side of the shank 10 as illustrated in FIG. 4. The drag of the counterweight on the bottom, coupled with the greater weight of the counterweight behind the pivot axis at 18 causes the flukes to immediately pivot toward the shank and into the bottom. Thus, as illustrated in FIG. 4, the anchor after first hitting bottom has the flukes extending in the same direction as the shank with the tips of the flukes resting on the bottom and the rear of the flukes elevated from the bottom. The projecting edge at the bottom of the triangular housing rests on the bottom, which elevates the rear of the flukes and also elevates the counterweight above the bottom. The opposite faces of the triangular housing thus can be referred to as elevating members, and each member can be referred to as an elevating ramp. The claws 48 on the bottom side of the anchor rest on the bottom and begin to penetrate the bottom. At this point the counterweight is near the bottom, behind the claws and also behind the pivot axis near the bottom of the shank.

As illustrated in FIG. 5, continued tension on the line (by pulling toward the right in FIG. 5) will cause the tips of the flukes to dig into the bottom and raise the bottom of the anchor above the bottom of the water. In a soft bottom, the flukes will dig in immediately, aided by the drag from the claws. In a hard bottom, the claws act as friction means to penetrate the bottom sufficiently to produce enough drag to force the tips of the flukes down into the bottom. The claws are curved toward the tips of the flukes to maximize the amount of drag and holding ability. The tips of the flukes are as sharp as possible which also maximizes the chance of penetration into a hard bottom. It is important that the claws be located between the flukes and the counterweight, with the claws and counterweight also being behind the pivot axis on a side of the pivot axis opposite the pointed tips of the flukes. In this way, the claws are stabilized on the bottom by the heavy weight of the counterweight. They are also forced down toward the bottom by the weight of the counterweight acting behind the claws. This improves the drag produced by the claws and aids in forcing the tips of the flukes into the bottom. Once the tips of the flukes have penetrated into the bottom, even to the slightest degree, continued tension on the line raises the bottom of the anchor such that the flukes move toward a vertical position as illustrated in FIG. 5 with the counterweight being elevated above the flukes. In this position, the heavy weight of the counterweight acting down on the pointed flukes assists in forcing the flukes further into the bottom. The shank is now at its maximum displacement from the plane of the flukes, and continued tension on the line at the end of the shank applies a downward component of force on the flukes, assisted by the counterweight, to force the flukes down into the bottom.

As force continues to be applied to the line, the flukes continue to be pulled farther into the bottom to the position illustrated in FIG. 6 where the flukes are eventually buried in the bottom.

The anchor of this invention is able to handle more angle of incidence ($37\frac{1}{2}°$) than the Danforth lightweight anchor. The anchor actually moves more bottom material with the flukes, giving greater resistance initially. The anchor body face 34 (see FIGS. 4, 5 and 6)

gives an additional 37½° resistance, forming a virtual wall or dam at actually 105° from the movement parallel to the anchor shank.

In actual use, even in a dense bottom, the anchor can normally assume a position in which the anchor and the shank are both buried in the bottom. In a softer bottom, by nature being more dense as the anchor burrows deeper, the shank tends to burrow more, tending to partially balance the drag above and below the pivot point. The weight in the anchor head helps hold the anchor down and stable.

In one experimental test of my anchor, the anchor was comparatively tested with a Danforth H-20 light weight anchor. The anchors were tested on a 25 foot, 6,500 pound boat in a bottom of dense, hard sand with a reasonably smooth surface, near Catalina Island. The Danforth anchor was off one side of the boat, and my anchor was off the other side of the boat. The line attached to the Danforth anchor included a 45 foot-long chain secured to the shank of the anchor. The line attached to my anchor included a 5 to 6 foot length of chain secured to the shank of the anchor. This difference was not considered to be of consequence, and as a matter of fact, a longer chain would be an advantage to the Danforth anchor. Both lines were tightened, and the boat was immediately anchored. Divers sent down to explore the results reported that my anchor had penetrated the dense sand at the bottom. On the other hand, the Danforth anchor was pulled all the way in without catching.

Separate tests were conducted on my anchor over a three-day period near Catalina. The anchor was tested on bottoms of all types. The anchor was dropped approximately twenty times over the three-day period. It was discovered that in all tests the boat did not move more than five feet from where my anchor first hit bottom.

It was also noted that there was a 25 mph wind at the surface at least one day, and periodic surges caused by wave action caused periodic pull on the line which actually pulled my anchor deeper into the bottom. Therefore my anchor is believed to be a good storm anchor. Experience has shown that with the Danforth anchor periodic surges at the surface caused by storm conditions can cause the Danforth anchor to pull out or float.

In addition to the improved penetrating ability and the ability to be used as a storm anchor, my anchor also has the advantage of being easily retrieved. It is particularly useful with an anchor guide such as that described in my U.S. Pat. No. 4,242,977. In many anchor designs, the flukes project to one side of the shank and can strike the side of the boat and damage the boat during retrieval. However, the flukes of my anchor remain in a vertical position when the anchor is pulled in, even when the shank is tilted from a vertical position. This essentially prevents the anchor from striking the side or bow of the boat.

The anchor also can be manufactured in a reasonably light-weight design, and therefore is easy to handle.

Although the anchor of my invention can be used as a light-weight anchor for small boats, the same concept also can apply to anchors of any size for use on any type of vessel. For large ships or commercial boats, the anchor can be cast from iron or steel, although a pivot hinge may be necessary.

With any shank design in this anchor, when used with the guide of my U.S. Pat. No. 4,242,977, the eye of the front end of the shank should open parallel to the hinge axis 20, and then a large chain link or properly designed shackle will orient the anchor each time it enters the tube.

Thus, the present invention provides an anchor which, when compared with equal weight anchors in the prior art, provides the best known combination of holding power in mud or soft sand; penetration to full set in denser bottoms; can be easily handled and facilitates self stowing; can be used as a storm anchor; can be adapted for use on large commercial ships as well as pleasure boats; and is readily manufactured of low or no rust materials.

What is claimed is:

1. A rotatable anchor having a shank and a body in the form of a rigid unit carried on the shank for rotating about an axis through the shank, the rigid unit comprising:

a pair of flukes lying in a common plane and formed as flat plates having opposite faces and pointed tips at one end of the rigid unit;

elongated elevating members extending across the width of the flukes and rigidly secured to lower portions of the flukes so that the elevating members extend downwardly away from the tips of the flukes and project outwardly beyond the opposite faces of the flukes;

a counterweight;

means rigidly securing the counterweight to a lower portion of the elevating members so the elevating members each form an elongated ramp extending outwardly and downwardly away from the flukes toward the counterweight, with each elevating ramp extending across the width of the flukes;

means mounting the rigid unit for rotation about a pivot axis through a lower portion of the shank so the flukes extend upwardly adjacent the shank with the tips of the flukes being remote from the pivot axis; and so that each elevating ramp extends outwardly and downwardly away from the pivot axis toward the counterweight; the counterweight being of sufficient weight and being spaced sufficiently far from the pivot axis that the turning moment produced by the counterweight about the axis is greater than the turning moment produced about the same axis by the flukes that extend above the axis; and spaced apart claws projecting outwardly beyond each elevating ramp and projecting toward the tips of the flukes for frictional contact with the bottom of a body of water so the flukes will pivot about the axis toward the bottom and so that the elevating ramp can rest on the bottom spaced from the pivot axis for holding the tips of the flukes in the bottom with the counterweight elevated well above the bottom so that continued pull on a line secured to the shank together with the greater turning moment of the counterweight about the axis causes the counterweight to force the tips of the flukes into the bottom to bury the anchor in the bottom.

2. Apparatus according to claim 1, in which the moment produced by the counterweight is sufficient to normally maintain the flukes in a generally upright position as the shank freely pivots relative to the rigid unit away from either side of a vertical plane through the flukes.

3. Apparatus according to claim 1, in which the claws are curved toward the tips of the flukes.

4. Apparatus according to claim 3, in which the pointed tips of the flukes are adjacent the outer edges of the flukes.

5. Apparatus according to claim 1, in which the counterweight is a solid metal block extending across the width of the flukes.

6. Apparatus according to claim 1, in which each elevating member extends continuously across substantially the entire width of the flukes.

7. Apparatus according to claim 6, in which the elevating members form an elongated tubular housing between the pivot axis and the counterweight.

8. Apparatus according to claim 7, in which the lower portion of the shank is pivotally mounted for rotation inside the tubular housing.

9. A rotatable anchor having a shank and a body in the form of a rigid unit carried on the shank for rotating about an axis through the shank, the rigid unit comprising:

a pair of flukes formed as flat plates having opposite faces and pointed tips;

an elongated tubular housing formed as an elevating ramp having opposite faces diverging from one another;

means rigidly securing the tubular housing to the flukes so that the flukes lie in a common plane with the tips of the flukes spaced remote from the tubular housing and so that the housing extends across the width of the flukes with the diverging opposite faces of the housing extending downwardly away from the tips of the flukes and projecting outwardly beyond the opposite faces of the flukes;

a counterweight;

means rigidly securing the counterweight to the side of the housing opposite from the tips of the flukes to position the tubular housing between the flukes and the counterweight;

means mounting the rigid unit for rotation about a pivot axis through a lower portion of the shank so the flukes extend upwardly adjacent the shank with the tips of the flukes remote from the pivot axis and so that the opposite faces of the elevating ramp formed by the housing extend downwardly away from the pivot axis toward the counterweight; the counterweight being on a side of the elevating ramp opposite from the tips of the flukes and being of sufficient weight and being spaced sufficiently far from the pivot axis that the turning moment produced by the counterweight about the pivot axis is greater than the turning moment produced about the same axis by the flukes that extend above the axis; and spaced apart claws mounted below the pivot axis between the tubular housing and the counterweight so the claws project outwardly beyond the opposite faces of the housing and beyond opposite faces of the counterweight, the claws projecting toward the tips of the flukes for frictional contact with the bottom of the body of water so the flukes will pivot about the axis toward the bottom with the elevating ramp holding the tips of the flukes in the bottom with the counterweight elevated well above the bottom so that continued pull on a line secured to the shank together with the greater turning moment of the counterweight about the axis causes the counterweight to force the tips of the flukes into the bottom to bury the anchor in the bottom.

10. Apparatus according to claim 9, in which the moment produced by the counterweight is sufficient to normally maintain the flukes in a generally upright position as the shank pivots freely relative to the rigid unit away from either side of a vertical plane through the flukes.

11. Apparatus according to claim 9, in which the claws are curved toward the tips of the flukes.

12. Apparatus according to claim 9, including a lower plate secured to the diverging opposite faces of the housing, and in which the counterweight is rigidly secured to the lower plate of the housing.

13. Apparatus according to claim 9, in which the opposite faces of the housing extend across substantially the entire width of the flukes.

14. Apparatus according to claim 9, in which the counterweight is a solid metal block extending across the width of the flukes.

15. Apparatus according to claim 9, in which the lower portion of the shank is pivotally mounted for rotation inside the tubular housing.

16. Apparatus according to claim 15, in which the shank is pivotally mounted for rotation by a pair of posts extending outwardly from the shank inside the housing, the diverging faces of the housing bearing against the posts for rotating the housing relative to the posts.

17. Apparatus according to claim 16, including a pair of bearing plates inside the housing for adding rigidity to the housing and to provide lower bearing surfaces for the posts.

18. Apparatus according to claim 9, in which the tips of the flukes are adjacent the outer edges of the flukes.

19. A rotating anchor having a shank and a body in the form of a rigid unit carried on the shank for rotating about an axis through the shank, the rigid unit comprising:

a pair of flukes lying in a common plane and formed as flat plates having opposite faces and pointed tips at one end of the rigid unit;

an elongated triangular shaped housing secured to lower portions of the flukes so the triangular housing extends across the width of the flukes with opposite faces of the triangular housing diverging outwardly from opposite faces of the flukes and downwardly away from the flukes to remote ends spaced below the flukes and forming elongated elevating ridges on opposite sides of the flukes and extending across the width of the flukes;

means pivoting the shank to the rigid unit so the opposite faces of the housing diverge from one another below the pivot axis;

an elongated counterweight rigidly secured to a base of the triangular housing on a side of the housing opposite from the pivot axis, the turning moment produced by the counterweight about the pivot axis being greater than the turning moment produced about the same axis by the flukes extending above the axis; and spaced apart claws secured along each elevating ridge of the housing and projecting toward the tips of the flukes so that the claws on each side of the rigid unit project outwardly beyond the elevating ridge and beyond the counterweight for frictional contact with the bottom of a body of water for rotating the rigid unit so the elevating ridge rests on the bottom for holding the tips of the flukes in the bottom spaced forward of the pivot axis and for elevating the counterweight above the bottom at a point spaced to the rear of the pivot axis, the housing, and the elevating ridge.

20. Apparatus according to claim 19 in which the triangular housing is of elongated tubular form and extends across substantially the entire width of the flukes.

21. Apparatus according to claim 19 in which the counterweight is a solid metal block spaced below the pivot axis and extending across the width of the flukes.

22. Apparatus according to claim 19 in which the shank is pivotally secured to the housing.

23. Apparatus according to claim 19 in which the claws are curved toward the tips of the flukes.

24. Apparatus according to claim 23, in which the pointed tips are adjacent the outer edges of the flukes.

* * * * *